US008567700B2

(12) United States Patent
Miedzius

(10) Patent No.: US 8,567,700 B2
(45) Date of Patent: Oct. 29, 2013

(54) SHOWERHEAD WITH 360 DEGREE ROTATIONAL SPRAY CONTROL

(76) Inventor: Christopher Miedzius, Newark, DE (US)

( * ) Notice: Subject to any disclaimer, the term of this patent is extended or adjusted under 35 U.S.C. 154(b) by 205 days.

(21) Appl. No.: 13/172,203

(22) Filed: Jun. 29, 2011

(65) Prior Publication Data

US 2013/0001324 A1 Jan. 3, 2013

(51) Int. Cl.
*B05B 1/32* (2006.01)

(52) U.S. Cl.
USPC ..... 239/457; 239/539; 239/541; 239/562

(58) Field of Classification Search
USPC ..... 239/453, 456–460, 538, 539, 540, 541, 239/552, 562, 556, 557, 558, 581.1, 581.2, 239/582.1
See application file for complete search history.

(56) References Cited

U.S. PATENT DOCUMENTS

| | | | | |
|---|---|---|---|---|
| 1,830,694 | A * | 11/1931 | Fraser | 239/460 |
| 2,689,151 | A * | 9/1954 | Manning | 239/458 |
| 3,013,729 | A | 12/1961 | McLean | |
| 3,065,917 | A | 11/1962 | Fraser | |
| 3,373,942 | A | 3/1968 | Roman et al. | |
| 3,383,059 | A | 5/1968 | Fahrbach | |
| 3,963,179 | A | 6/1976 | Tomaro | |
| 4,117,979 | A | 10/1978 | Lagarelli et al. | |
| 4,303,201 | A | 12/1981 | Elkins et al. | |
| 5,172,866 | A | 12/1992 | Ward | |
| 5,398,872 | A | 3/1995 | Joubran | |
| 5,518,181 | A | 5/1996 | Shames et al. | |
| 5,862,985 | A | 1/1999 | Neibrook et al. | |
| 5,918,811 | A | 7/1999 | Denham et al. | |
| 5,961,046 | A * | 10/1999 | Joubran | 239/107 |
| 6,214,224 | B1 | 4/2001 | Farley | |
| 6,223,998 | B1 * | 5/2001 | Heitzman | 239/383 |
| 6,378,790 | B1 | 4/2002 | Paterson et al. | |
| 6,869,030 | B2 | 3/2005 | Blessing et al. | |
| 7,114,666 | B2 | 10/2006 | Luettgen et al. | |
| 7,520,448 | B2 | 4/2009 | Luettgen et al. | |
| 2010/0065665 | A1 | 3/2010 | Whitaker et al. | |

OTHER PUBLICATIONS

Baumeister, Theodore et al, Marks' Standard Handbook for Mechanical Engineers 10$^{th}$ Edition, pp. 8-4 to 8-7, 1996.

* cited by examiner

*Primary Examiner* — Christopher Kim
(74) *Attorney, Agent, or Firm* — Novak Druce Connolly Bove + Quigg LLP

(57) ABSTRACT

A showerhead is disclosed with a control surface about the lower periphery of the showerhead that can be continuously rotated through 360 degrees to control the water spray patterns exiting the showerhead. The control surface is mechanically linked by a cam track and mating cam followers to a set of plungers in the showerhead faceplate. The plungers can be axially moved within openings in the faceplate of the showerhead by rotation of the control surface. That axial movement of the plungers allows a user's adjustment of the spray patterns exiting the showerhead.

6 Claims, 5 Drawing Sheets

96
14
38
34
35
70
59
34
40
50
62
42
64

78
70
72
34
35
84
74
76
82
34

SHOWERHEAD WITH 360 DEGREE ROTATIONAL SPRAY CONTROL

BACKGROUND OF THE INVENTION

The showerhead of this invention is generally of the type disclosed in U.S. Pat. No. 5,918,811 issued to Speakman Company, the assignee of this application. Other Speakman patents related to such showerheads include U.S. Pat. Nos. 3,013,729; 3,005,917; 3,373,942; 3,383,059, 4,117,979 and 6,378,790. Speakman Company is a leader in the field of adjustable spray pattern showerheads sold under the ANYSTREAM® trademark. The adjustable spray pattern pioneered by Speakman is based upon axial movement of plungers within openings in a showerhead faceplate as explained in greater detail in the specifications of above-listed patents.

That movement of the plungers in existing ANYSTREAM showerheads is controlled by rotation of a handle laterally extending from the body of the showerhead. That handle is rotated by the user to change spray patterns emanating from the showerhead faceplate. Rotation of the handle is translated into vertical (axial) movement of the plungers within the faceplate using an off-center pin received in a slot formed in a plunger holder. With this arrangement, a small rotation of the handle is translated into axial movement of the plungers within the showerhead faceplate. That movement opens grooves of differing dimensions around the periphery of the plungers or openings in the faceplate to adjust flow of water from the showerhead. Those dimensional differences account for the variability in spray patterns and volume of flow achievable in the Speakman ANYSTREAM® showerhead.

While the use of a handle on the side of a showerhead to adjust spray patterns has met with tremendous commercial success and consumer acceptance over many decades, a need has arisen for more ergonomic and robust means for adjusting those spray patterns.

Means are thus desired that facilitate adjustment by a bather that has his/her eyes closed and is literally "feeling in the dark" to, first, find the showerhead and, second, to adjust the spray pattern emanating therefrom. Applicant has found that bathers generally, even with their eyes shut, can locate a showerhead faceplate by just tracing the water flow pattern to its origin as it exits the showerhead. This location for adjusting a showerhead spray pattern also obviates those situations where bathers have difficulty in locating a handle on the side of a showerhead, especially when the showerhead face (closest to the bather) is wide. These wider showerheads force a user to reach up and around the wide face of the showerhead to reach a handle. Accordingly, a control surface near the front of a showerhead has ergonomic advantages.

This arrangement also has aesthetic advantages over showerheads with side handles because the spray adjustment means can be incorporated into the shell of the showerhead rather than extending laterally therefrom.

In addition, it has been found that most showerheads that have a rotating control surface near the front of the showerhead have stops that prevent full 360° rotation of the surface. In non-domestic installations such as hospitals, fitness centers and the like attempts to force the control surface to rotate beyond its designed degree of rotation disabled the spray adjustment feature of the showerhead. This has created customer dissatisfaction with such showerheads having less than 360° rotation of the control surface.

Showerheads manufactured and sold by other than Speakman Company have also been found wanting because control surfaces adjacent the front of the showerhead were not linked to plungers movable within openings in the faceplate. That movement provides variable spray patterns so important to consumer acceptance of showerheads.

SUMMARY OF THE INVENTION

The invention of this application provides a new advance in showerhead technology by providing enhanced ergonomic and functional operation of ANYSTREAM®-type showerheads. More specifically, it discloses a control surface near the faceplate for this type of showerhead that can be continuously rotated in both directions (clockwise and counterclockwise) through 360°. That rotation, through suitable interaction between cam surfaces in the interior stem of the showerhead and cam followers on a plunger holder, facilitates axial movement of plungers through openings in the showerhead faceplate. This movement of the plungers enables a wide variation in spray patterns flowing from the showerhead.

Optionally, a pulsating, vibrating spray head can be included in the showerhead of this invention, preferably in a central opening in the faceplate of the showerhead.

DETAILED DESCRIPTION OF THE INVENTION

One embodiment of the present invention comprises a showerhead in which the spray pattern emanating therefrom is established by passing water through peripheral slots in faceplate openings surrounding movable plungers arranged within those openings as more fully described in U.S. Pat. No. 5,918,811. In another embodiment (not illustrated) the peripheral slots are formed in the plungers as described in U.S. Pat. No. 6,378,790. Of particular importance is the improved mechanism used in the showerhead to move the plungers within those openings. That mechanism translates rotational movement of a control surface into axial (longitudinal) movement of the plungers within the openings of the showerhead.

The effect of this axial plunger movement within the faceplate openings upon shower spray patterns is described in U.S. Pat. Nos. 5,918,811 and 6,378,790. The disclosures of these patents are incorporated herein by reference. Those disclosures explain how large variations in the intensity and spread of the shower spray pattern can be adjusted by carefully controlling 1) the geometry of the individual grooves surrounding the discharge openings in the showerhead faceplate or in the plungers and 2) axial (longitudinal) movement of plungers within the openings.

Figure 1:
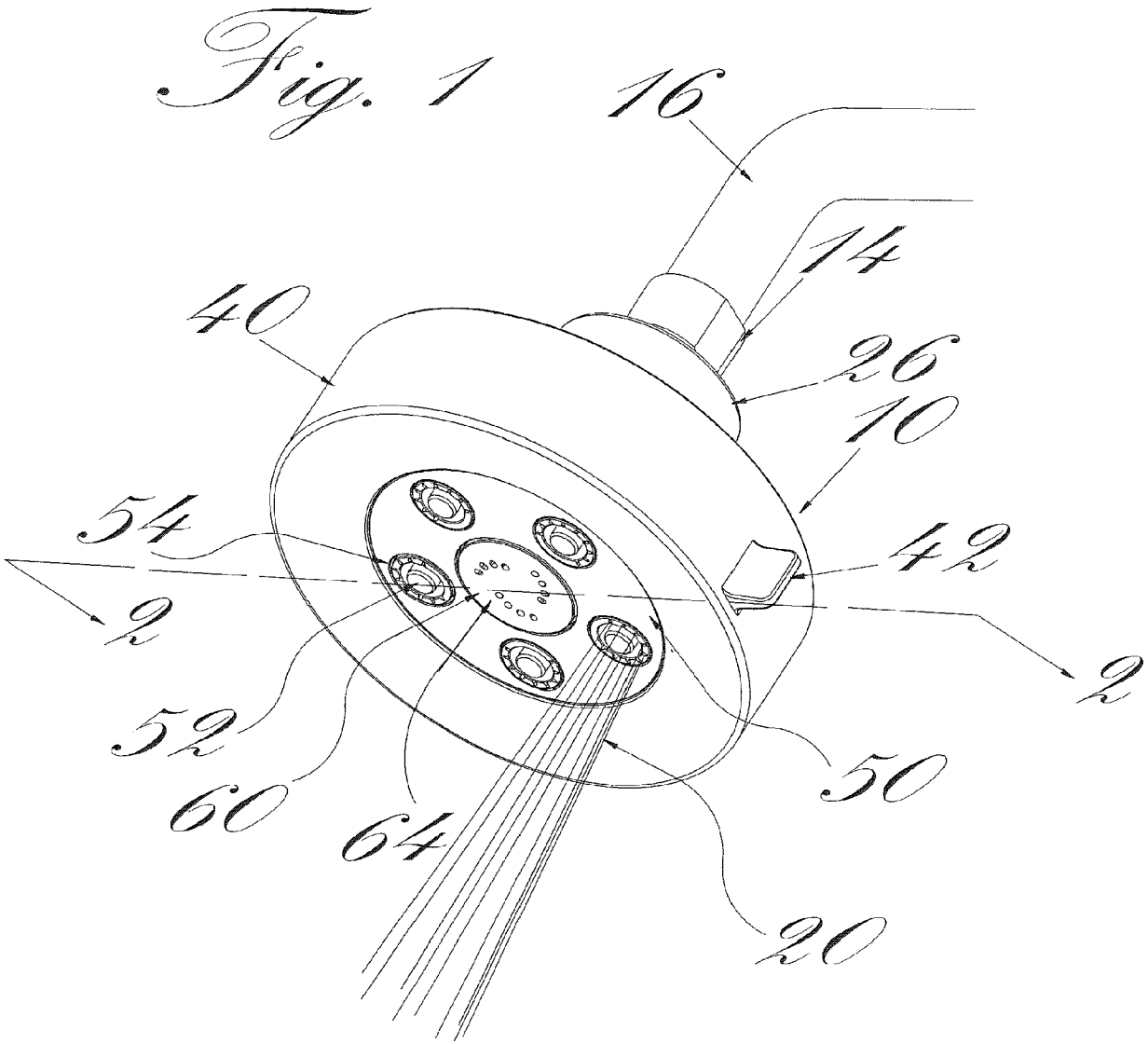
FIG. 1 is a perspective view of the showerhead of this invention.

An exterior perspective view of the showerhead of this invention is shown in FIG. 1. This Figure illustrates the showerhead 10 of this invention with a standard ball joint 14 with internal threads 18 for attachment of the showerhead to a domestic water supply 16. The ball joint 14 has an internal water passage therethrough for channeling water to the interior of showerhead 10 and ultimately exiting in the form of a shower spray 20. The ball joint 14 can include a suitable flow control device 22 to limit water consumption in conformance with local or national plumbing codes. A seal 24 surrounds the lower reaches of the ball joint to seal it within the upper showerhead shell 26 (See FIG. 2).

The upper showerhead shell 26 at its end 28 closest to the water supply 16 surrounds at least a portion of the ball joint 14 and is maintained in water tight contact therewith by seal 24. Internal threads 30 on end 28 of upper showerhead shell 26 are designed to receive the mating threads on the upper stem of the ramp means 34 thereby securing the ramp means 34 in a fixed, non-rotating position relative to the upper showerhead shell 26.

Figure 2:
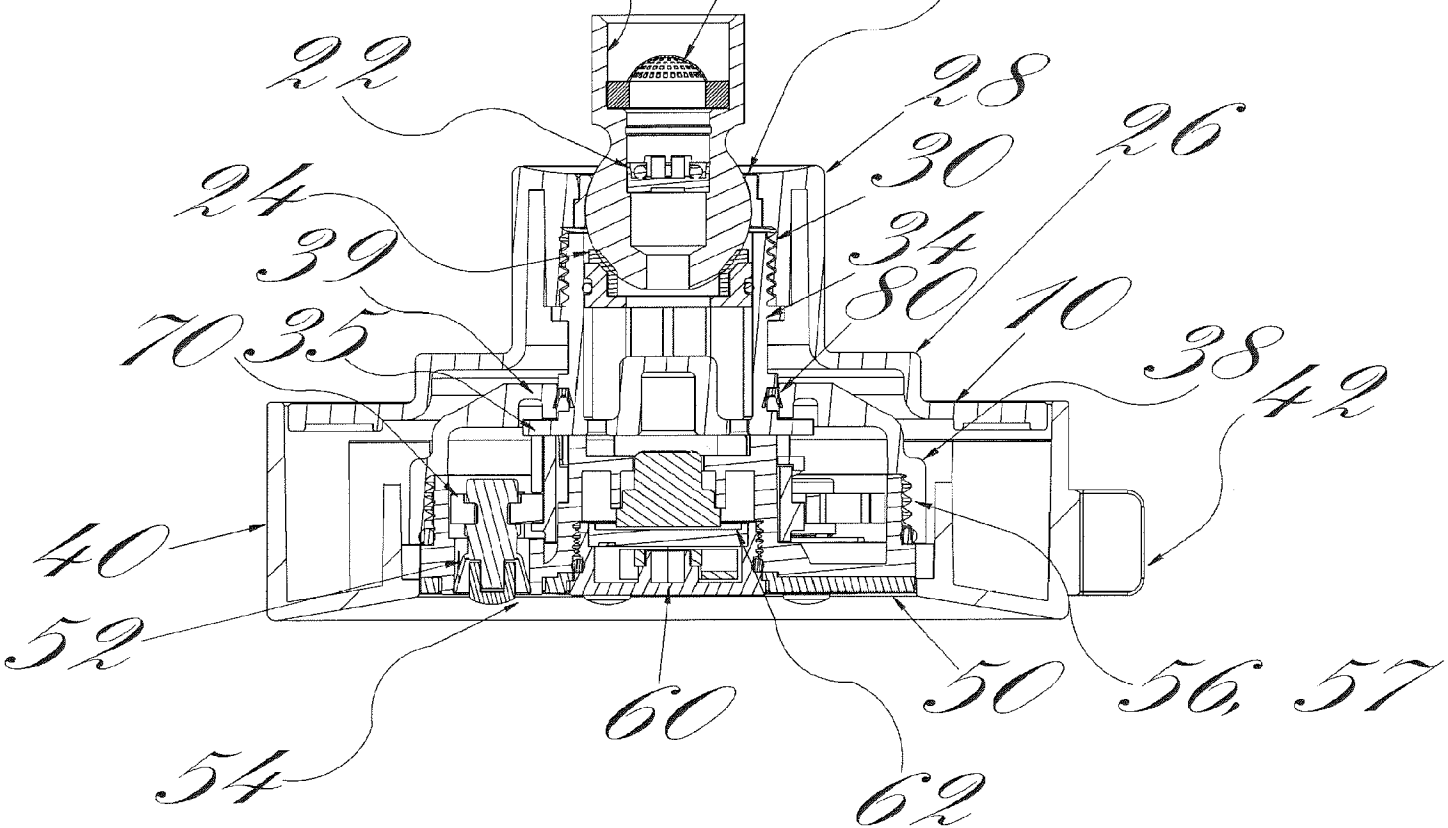
FIG. 2 is a cross-sectional view of the showerhead along lines 2-2 of FIG. 1.

Turning to means used to control movement of plungers within the showerhead, the lower showerhead body 38 has an inwardly directed flange 39 with a central circular opening that sits on a lower lip 35 of ramp means 34 (see FIG. 2). The flange 39 of the lower showerhead body 38 is free to rotate in both directions across the mating lip 35 of ramp means 34. Thus, unlike the upper showerhead shell 26, it is readily rotatable in either direction through a 360 degree-plus arc thereby permitting easy adjustment of the showerhead plungers within the openings as more fully described below.

Figure 3:
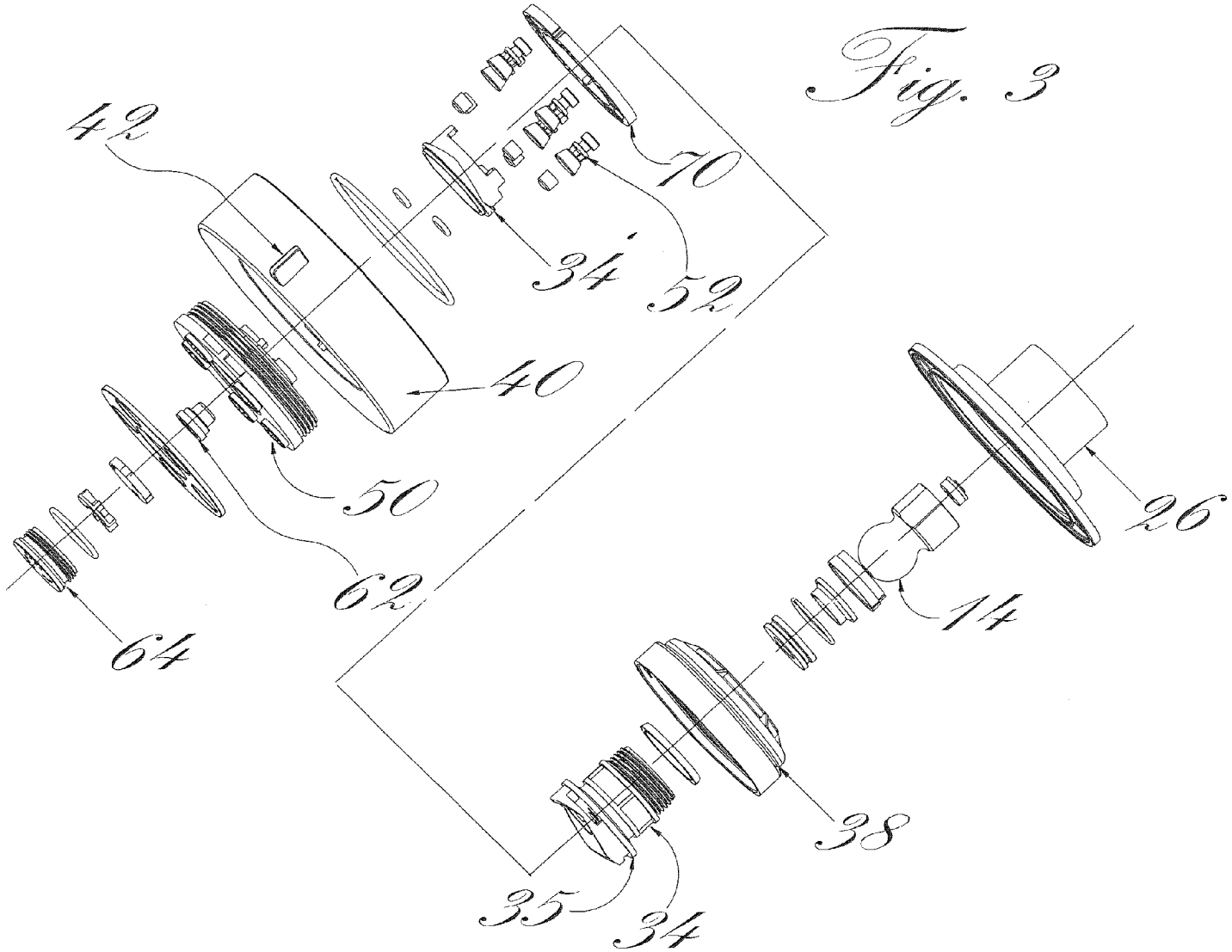
FIG. 3 is an exploded view of the parts comprising the showerhead.

Control surface 40 is illustrated in an exploded view of the showerhead shown in FIG. 3. As the name implies this is a surface that can be grasped by a bather to control the spray pattern exiting the showerhead. It is fixedly attached to lower showerhead body 38 and rotates with the latter. To better enable a bather to rotate the circular control surface 40, a tab 42 can be added to its periphery. When tab 42, for example, is oriented at the 3 o'clock position (as viewed by a bather standing underneath the showerhead) the plungers are at their furthest downward position. At that position there is a maximum amount of area within the grooves on the periphery of the plungers or in the faceplate openings available for passage of water out of a showerhead. Further rotation of tab 42 to a position that maximizes drainage of water out of the showerhead can be used after a shower is completed. This has been found to minimize or avoid bothersome dripping of water out of the showerhead after use.

Completing the exterior of the showerhead is faceplate 50. The faceplate has multiple openings 54 surrounding moveable plungers 52 preferably located in a symmetrical circular array near the periphery of the faceplate 50. The plungers 52 are dimensioned to fit with sliding friction interference within the interior surfaces of the openings 54 in the faceplate. Those openings may be configured with internal grooves and/or wiping lip of the type disclosed in Speakman U.S. Pat. Nos. 5,918,811 and 6,378,790.

Optionally, faceplate 50 can include a central chamber in which a vibratory spray head 60 can be placed. A vibratory spray pattern can be generated by any of several known means including a "wobble plate" or a "turbine", preferably the latter. In a turbine device, multiple holes 64 in the center of faceplate 50 are alternately blocked and opened by a turbine-like blade 62. This creates a massage-type impact on a bather's skin Turning from the exterior of showerhead 10 to its interior parts, the upper and lower showerhead shell 26 and body 38, respectively, must be capable of rotating independently of each other. More particularly, the lower showerhead body 38 must be capable of 360 degree-plus rotation either clockwise or counterclockwise relative to the stationary upper showerhead shell 26. Lower showerhead body 38 is fixedly connected to control surface 40 when the faceplate 50 is screwed into the lower showerhead body 38 (FIG. 3). This captures control surface 40 so that all three parts rotate as one. That rotation, in turn is translated into vertical movement of the plungers as explained below.

Figure 4:
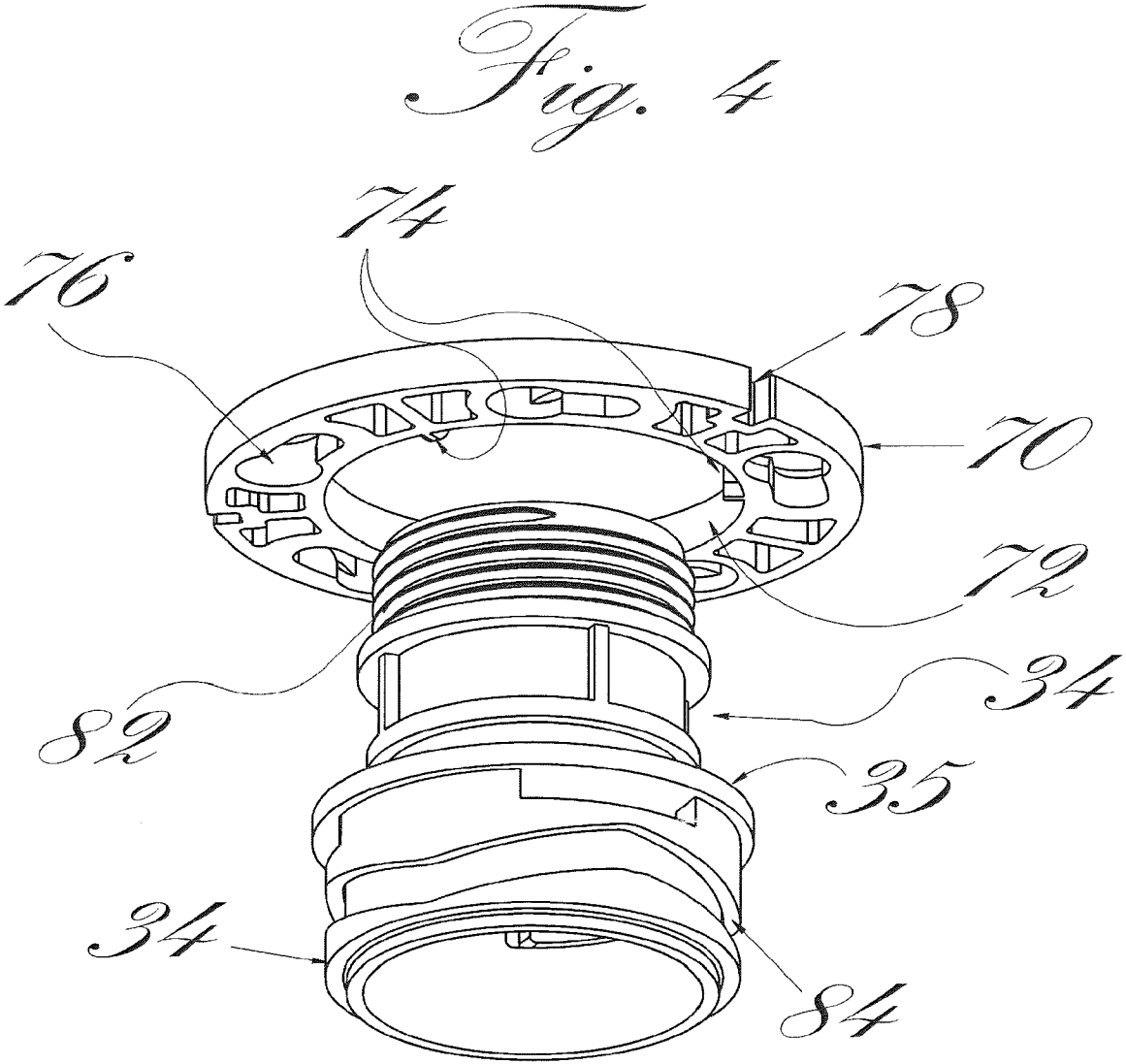
FIG. 4 is an enlarged perspective view of parts of the showerhead principally responsible for translating rotational into axial movement, namely plunger holder and ramp means.

The principal components enabling this transition from rotational to axial movement are illustrated in FIG. 4. The first of the parts of this assembly shown in FIG. 4 is a plunger holder 70. This plunger holder is generally circular in shape having an interior opening 72 with cam followers 74 arrayed around the interior periphery. To achieve a compromise between stability and reduction of contact friction with its associated camming surface described below, it is preferred to have three or four such cam followers 74 about the interior opening of plunger holder 70.

Between the interior opening 72 and outer periphery of plunger holder 70 are several keyhole shaped slots 76 which are dimensioned to hold the necks of the individual plungers in a manner disclosed in U.S. Pat. No. 5,918,811.

Figure 5:
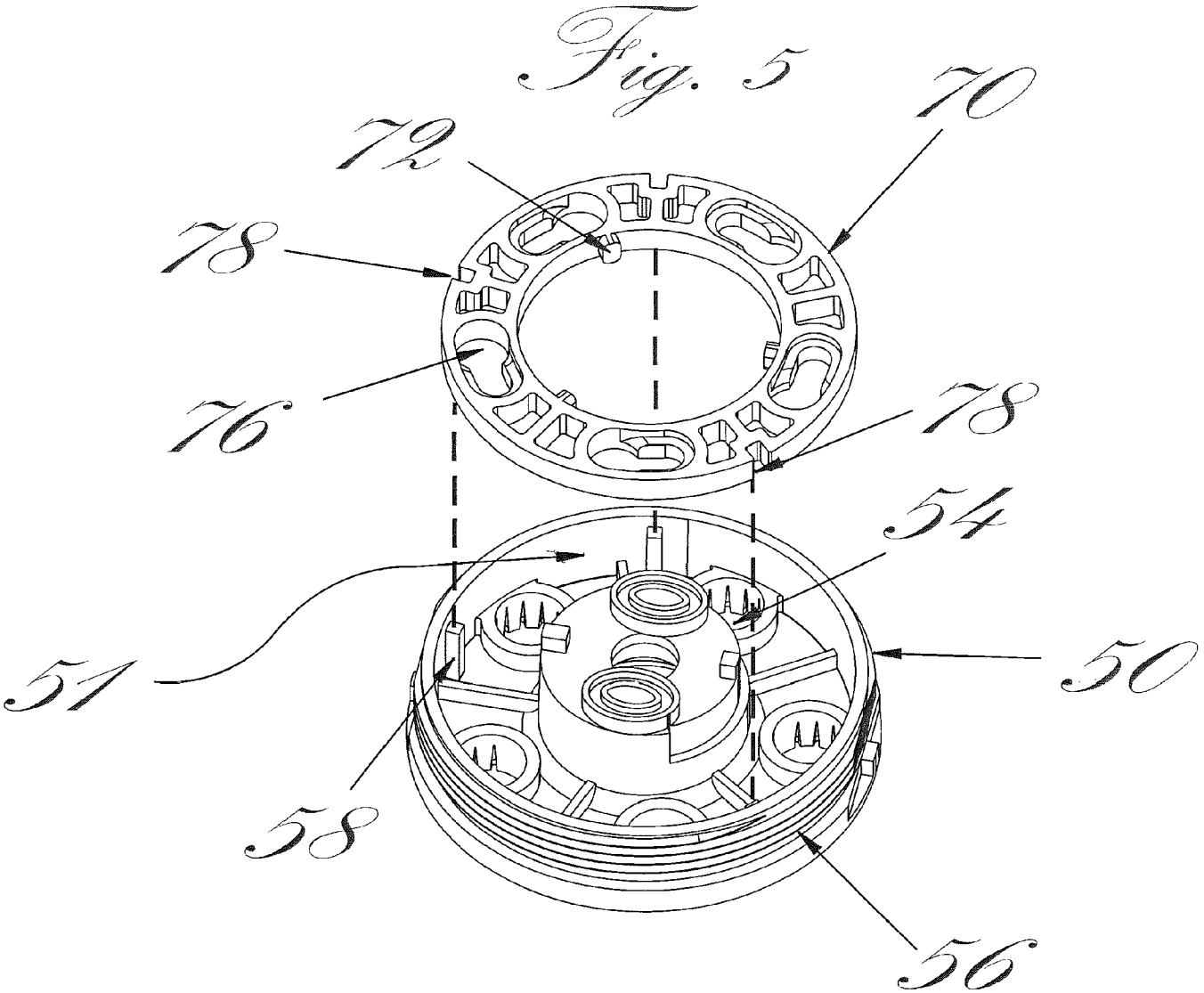
FIG. 5 is an enlarged perspective view of parts of the showerhead used to hold and guide plungers within openings in the showerhead faceplate.

Another component of the apparatus for translating rotational movement to axial movement is the ramp means 34 illustrated in FIG. 4. This ramp means has an upper threaded end 82 which is affixed to a threaded interior surface of the upper showerhead shell 26 as illustrated in FIG. 2. Lip 35 of ramp 34 supports the rotatable lower showerhead body 38 as previously described. A seal 80 at the point where the lower showerhead body 38 rests on the lip 35 of ramp means 34 provides a watertight rotating connection between the lower showerhead body 38 and the other parts carrying pressurized water in the upper portion of the showerhead, primarily the area within ramp means 34. Ramp means 34 contains a circumferential camming track 84 recessed in the lower periphery of ramp means 34. The camming track 84 is dimensioned to receive cam followers 74 on plunger holder 70. When the plunger holder 70 is rotated about the fixed ramp means 34 it moves up and down along the longitudinal axis of the showerhead. The plungers 52 attached to the plunger holder via slots 76 will move upwardly and downwardly within the confines of the faceplate 50. Orientation of the plunger holder relative to the faceplate is necessary so that the plungers are always aligned with openings 54 in the faceplate 50. This is accomplished with mating ribs 58 and slots 78 on the faceplate 50 and plunger holder 70, respectively, as shown in FIG. 5.

To enable positioning of plunger holder 70 and its cam followers 74 into camming track 84, the ramp means is initially manufactured in two parts 34 and 34' as shown in the exploded view of FIG. 3. Those two parts are then mated by suitable means.

The faceplate 50 is fixed relative to control surface 40, with screw threads in an upstanding portion of the face plate (see FIG. 5) which allow fastening of the faceplate 50 to the interior of the lower showerhead body 38 via mating screw threads 56, 57 which in turn captures the control surface 40 as described above (see FIG. 2). Translation of movement from rotational to axial is achieved by rotation of the plunger holder 70 around the fixed ramp means 34. This is achieved by linkage of the plunger holder 70 to the interior of control surface 40 through faceplate 50. Within the faceplate 50 are vertical columns 58 that are arranged around the inner periphery of the upstanding wall 51 of faceplate 50. These columns are spaced and sized to allow matching grooves 78 in plunger holder 70 to move up and down on columns 58 thereby maintaining the plungers in alignment with the openings 54 in faceplate 50. The plungers 52 held by the plunger holder 70 move axially to expose varying groove cross sections resulting in varying spray patterns as discussed above, as the faceplate 50, which is linked to control surface 40, is rotated.

I claim:

1. A showerhead comprising:

a showerhead body having an upper water inlet and lower water outlet on opposite portions thereof;

a rotatable faceplate extending substantially across the water outlet with multiple openings therein for controlled passage of water therethrough;

multiple plungers axially movable along at least a portion of their length within the openings in the faceplate for adjusting the spray patterns of water emitted by the showerhead;

a generally circular plunger holder with an interior central opening therein axially movable with the plungers and having multiple cam followers on the central opening;

a manually rotatable annular control surface surrounding the faceplate rotatable with the faceplate and axially moveable plunger holder; and;

a stationary cam surface within the showerhead body, including a programmed cam surface operatively connected to the cam followers, wherein rotation of the control surface is translated into axial movement of the plunger holder and associated plungers within the openings of the faceplate.

2. The showerhead of claim 1 wherein the control surface is rotatable a full 360°.

3. The showerhead of claim 2 wherein the control surface is rotatable both clockwise and counterclockwise.

4. The showerhead of claim 1 wherein a tab extends laterally from the control surface to assist rotation of the control surface.

5. The showerhead of claim 1 wherein the plunger holder contains slots into which a portion of each plunger is retained.

6. A mechanism for translating rotational movement to axial movement in a showerhead comprising:

a showerhead body;

a water inlet in a first portion of the showerhead body;

a water outlet in a second portion of the showerhead body which outlet has a faceplate with openings for axial movement of plungers therein;

a generally circular rotatable control surface surrounding the water outlet operatively connected to a circular plunger holder, the plunger holder having an interior opening therein containing multiple cam followers around the inner periphery of the opening;

a circular ramp means fixedly attached to the showerhead body having a programmed recessed cam surface therein for receipt of the cam followers wherein rotation of the control surface is translated into axial movement of the plunger holder to move plungers attached to the plunger holder axially relative to the openings in the faceplate upon rotation of the control surface.

* * * * *